US006658986B2

(12) United States Patent
Pitla et al.

(10) Patent No.: US 6,658,986 B2
(45) Date of Patent: Dec. 9, 2003

(54) COMPRESSOR HOUSING WITH CLAMP

(75) Inventors: Srinivas S. Pitla, Ann Arbor, MI (US); Chang Yun Ching, Westland, MI (US); Vipen Khetarpal, Novi, MI (US); Mirza Qadir M. Baig, Inkster, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 83 days.

(21) Appl. No.: 10/120,688

(22) Filed: Apr. 11, 2002

(65) Prior Publication Data

US 2003/0194331 A1 Oct. 16, 2003

(51) Int. Cl.[7] ..... F01B 3/00; F01B 13/04; F04B 35/00; F04B 1/12

(52) U.S. Cl. ..... 92/71; 417/360; 417/269; 91/499

(58) Field of Search ..... 417/360, 269; 92/71; 91/499; 74/606 R

(56) References Cited

U.S. PATENT DOCUMENTS 2,160,735 A * 5/1939 Hoffer ..... 417/269
2,381,585 A * 8/1945 Gambrell ..... 417/499
3,754,842 A * 8/1973 Schlanzky ..... 417/269
4,065,229 A * 12/1977 Black ..... 417/270
4,171,571 A * 10/1979 Gritter ..... 433/120
4,492,535 A 1/1985 Stahlkopf
4,526,516 A * 7/1985 Swain et al. ..... 417/222.2
4,648,788 A 3/1987 Jochum
4,740,144 A 4/1988 Biek
5,574,246 A 11/1996 Meyers et al.
6,318,972 B1 11/2001 Huang et al.

* cited by examiner

*Primary Examiner*—Justine R. Yu
*Assistant Examiner*—Timothy P. Solak
(74) *Attorney, Agent, or Firm*—MacMillan Sobanski & Todd LLC

(57) ABSTRACT

A housing assembly for a refrigerant compressor in an air conditioning system includes a forward housing portion, and a rearward housing portion. The two mate together to contain the internal components and seal the compressor. A clamp engages the forward and the rearward housing portions and is rotated to compress the two together. It maintains a desired clamping force under various operating and environmental conditions.

20 Claims, 4 Drawing Sheets

COMPRESSOR HOUSING WITH CLAMP

BACKGROUND OF INVENTION

The present invention relates to air conditioning compressors and more particularly to the housings for air conditioning compressors.

Conventionally, for compressors employed in the air conditioning systems of vehicles, the housing is assembled from at least two separate parts. Typically, bolts are employed to hold the separate parts of the housing together. The bolts not only hold the housing together, but they also must provide a certain compressive load in order to assure that the housing seals properly. If not, refrigerant can leak out. A housing that is held together with bolts is not particularly well suited for this because the housing is usually made out a aluminum and the bolts are made out of steel. These materials have different thermal expansion characteristics. When the temperature in the engine compartment of a vehicle changes dramatically, the aluminum housing and the steel bolts expand at different rates, which changes the amount of compressive load—thus, the clamping loads can vary substantially from the clamping loads obtained during assembly of the compressor.

The appropriate clamping load can be very important to assuring that the housing seals adequately. This is particularly true as new refrigerants may be used in the near future that operate in much higher pressure ranges than current refrigerants. Thus, it is desirable to have a housing assembly for an air conditioning compressor that overcomes the drawbacks of the bolted together housing assemblies. In particular, one that will allow for adequate sealing of the housing, while still remaining simple to assemble, light weight and cost effective, as is required to meet the demands in today's automotive vehicles.

SUMMARY OF INVENTION

In its embodiments, the present invention contemplates a compressor for an air conditioning system. The compressor includes a first housing with an outer wall having an end with external threads thereon and an inner wall defining an inner cavity, and a component mounted partially within the inner cavity that has an outer surface sealingly engaging the inner wall. The compressor also includes a second housing having an inner wall defining an inner cavity for sealingly receiving a portion of the component along the component outer surface, and with the second housing including an engagement portion having an engagement device thereon. A clamping member, having a generally hollow cylindrical shape, includes a first set of internal threads that threadably engage the external threads on the first housing, and includes a second engagement device operatively engaging the engagement portion of the second housing such that rotation of the clamping member in a first direction will cause the first and the second housings to be pulled toward one another, and rotation of the clamping member in a second opposite direction will allow the first and the second housings to be pushed away from one another.

An advantage of the present invention is that the components of an air conditioning compressor housing can be assembled together and seal adequately within a wide temperature range.

Another advantage of the present invention is that the air conditioning compressor housing assembly is cost effective, assembles relative easily and minimizes the weight of the overall housing.

DETAILED DESCRIPTION

Figure 1:
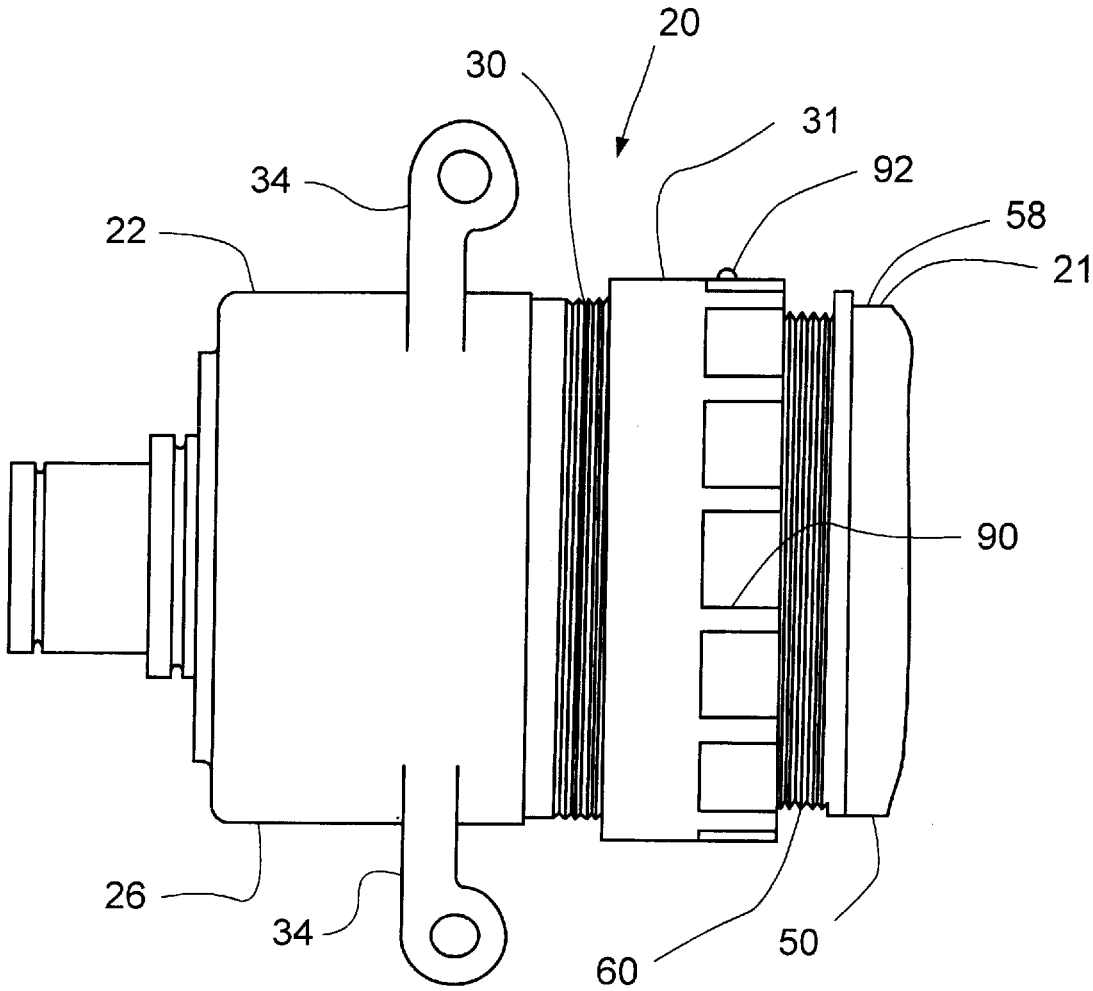
FIG. 1 is a side view of a portion of a compressor assembly in accordance with the present invention.
Figure 2:
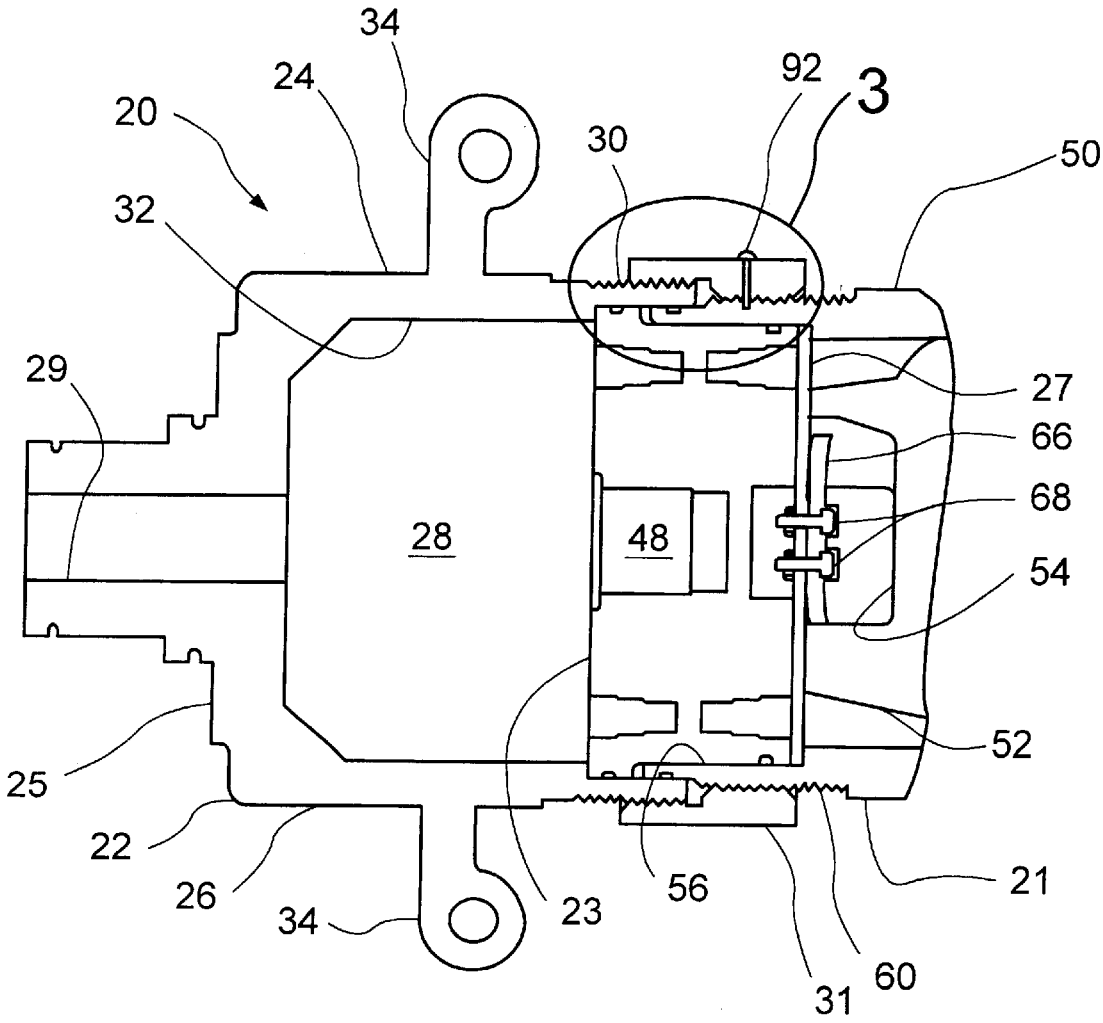
FIG. 2 is a sectional view of a portion of the compressor assembly in accordance with the present invention.
Figure 3:
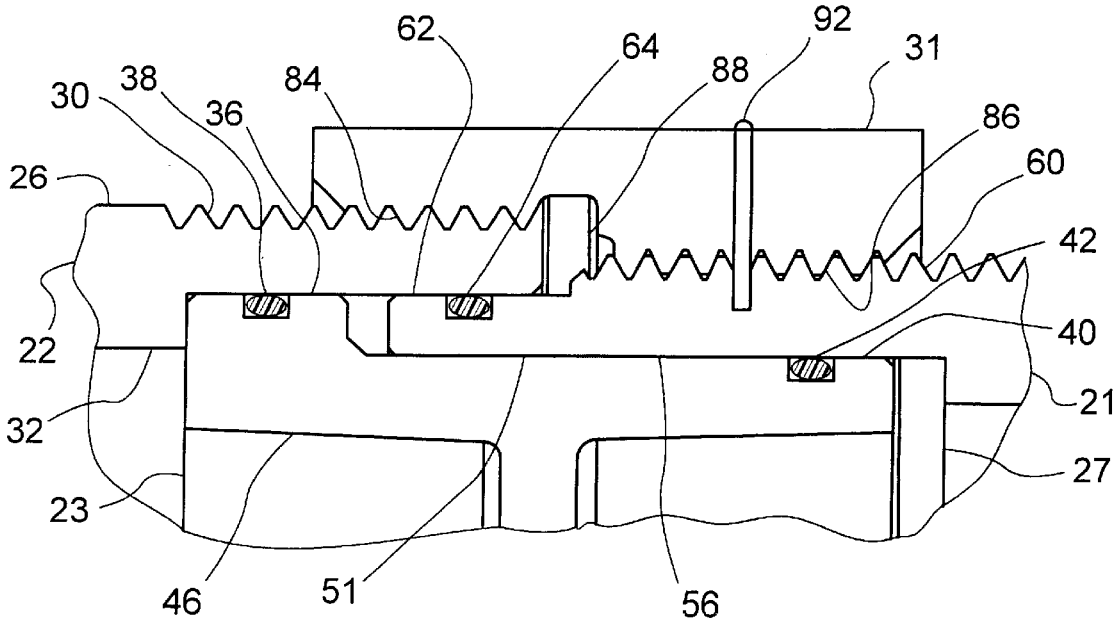
FIG. 3 is a view of encircled area 3 in FIG. 2, on an enlarged scale.
Figure 4:
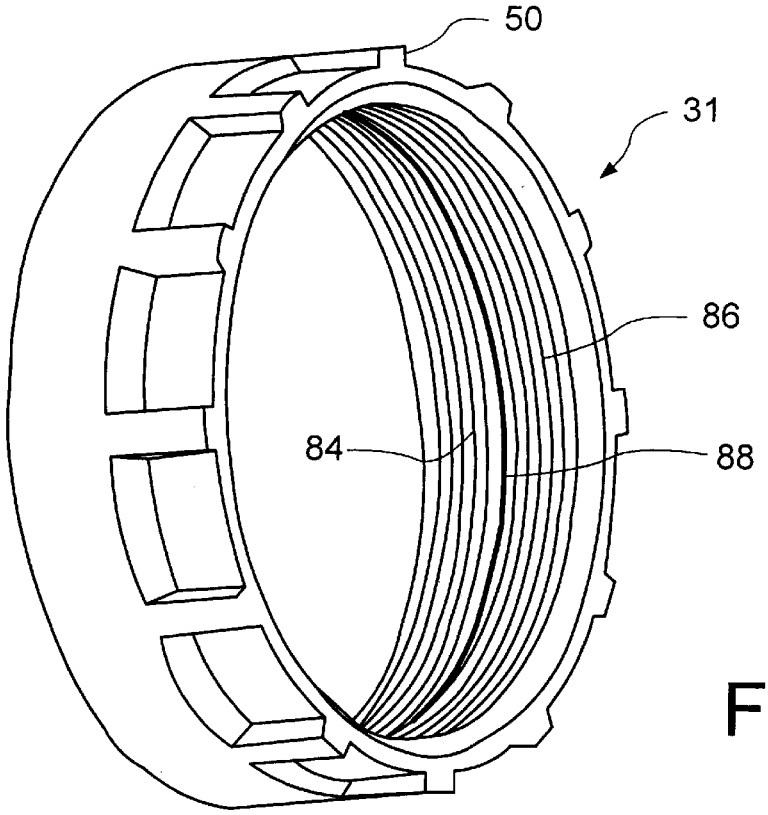
FIG. 4 is a perspective view of a ring clamp in accordance with the present invention.
Figure 5:
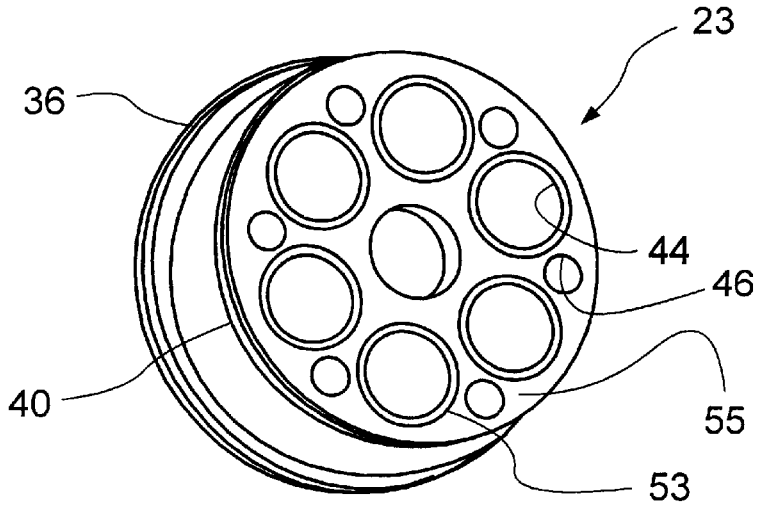
FIG. 5 is a perspective view of the cylinder housing in accordance with the present invention.

FIGS. 1–5 illustrate a first embodiment of an air conditioning compressor housing assembly 20, in accordance with the present invention. The housing assembly 20 is designed to form a portion of a piston-type refrigerant compressor. The pistons, drive mechanism, and other components are not illustrated herein, but are conventional in nature and are well know to those skilled in the art of refrigerant compressors for automotive vehicles. For example, the other components may be similar to those of a swash plate refrigerant compressor, as disclosed in U.S. Pat. No. 6,318,972, incorporated herein by reference. While the example in the preferred embodiment illustrates a compressor housing for a swash plate type of compressor, the present invention is also applicable to other types of refrigerant compressors as well.

The housing assembly 20 includes a front housing portion 22 (also sometimes called a crankcase), a rear housing portion 21 (also sometimes called a cylinder head), a cylinder block 23, a valve plate assembly 27, and a ring clamp 31. When referring to front and rear herein, the wording is merely used for convenience in describing the assembly and the orientation of the parts relative to one another, but does not imply any particular orientation of the assembly within a vehicle.

The front housing portion 22, rear housing portion 21, and the ring clamp 31 are preferably made of aluminum, although they may be made of other materials. Preferably, these three components are all formed from the same material in order to reduce the effect of any thermal stresses—although they can be different materials if required. The valve plate 27 is preferably made of steel, although it may also be made of other materials.

The front housing portion 22 has a cylindrical wall 24 integral with an end wall 25. The end wall 25 includes a driveshaft passage 29 therethrough. The cylindrical wall 24 includes an outer surface 26, and an inner surface 32, which defines an inner cavity 28 (also called a crankcase cavity) open at its rear end. The cylindrical wall 24 also includes a first set of external threads 30 on its outer surface 26 surrounding the opening at the rear end of the front housing 22. A pair of mounting bosses 34 extend from the front housing 22, and are use to mount the housing 20 in an engine compartment of a vehicle (not shown).

The cylinder block 23 has a forward, outer surface 36, which is generally cylindrical and slides within the inner cavity 28 with a small clearance between the outer surface 36 and the inner surface 32 of the front housing 22. A first O-ring seal 38 mounts within a seal recess and presses against the inner surface 32, sealing between the front housing 22 and the cylinder block 23. The cylinder block also includes a rearward, outer surface 40, which is generally cylindrical in shape. It includes a seal recess within which is mounted a second 0-ring seal 42. The cylinder block 23 has six piston cylinders 44 extending therethrough, twelve weight reduction bores 46, and a central bore 48 for receiving and mounting a shaft and bearing assembly (not shown).

The rear face 55 of the cylinder block 23 includes a recess around each piston cylinder opening for receiving cylinder O-ring seals 53, which seal between the rear face 55 and the valve plate assembly 27. In the alternative, a gasket can be used between the rear face 55 of the cylinder block 23 and the valve plate 27, although this may require a higher clamp load in order to provide the desired sealing.

The cylinder block 23 can be formed from aluminum, steel or iron. It can be made of iron without concerns with possible corrosion because it is completely sealed within the front housing portion 22 and rear housing portion 21, and so it is not exposed to the environment external to the housing assembly 20.

The rear housing portion 21 includes an outer, cylindrical wall 50, which encloses a suction chamber 52 and a discharge chamber 54, as well as various passages (only partially shown) for receiving refrigerant into and sending refrigerant out of the compressor housing 20. The cylindrical wall 50 also has an inner surface 51, which forms a cylinder block cavity 56 forward of the suction 52 and discharge 54 chambers.

An outer surface 58, of the cylindrical wall 50, includes a threaded portion 60 around its circumference, near the forward end, and a cylindrical sealing portion 62 forward of the threaded portion 60. The cylindrical sealing portion 62 slides within the inner surface 32 of the front housing portion 22, with minimal clearance between 30 them. The cylindrical sealing portion 62 includes a recess that receives a third O-ring seal 64, which seals against the inner surface 32. Also, the inner surface 51 of the cylindrical wall 50 seals against the second O-ring 42, since the rearward outer surface 40 of the cylinder block 23 fits within the cylinder block cavity 56 with minimal clearance. Of course, even though the rear housing portion 21 is shown sliding within the front housing portion 22, the design of the joint configuration can be reversed, with the front housing portion having a smaller diameter outer surface that slides within the rear housing portion. Also, the front and rear housing portions and cylinder block can have locating pins and corresponding holes to assist with maintaining the orientation of the parts during assembly.

The valve plate assembly 27 mounts between the cylinder block 23 and the rear housing portion 21. It has a valve retainer 66 mounted to it with bolts 68.

The ring clamp 31 is a generally cylindrical member with a forward set of internal threads 84, a rearward set of internal threads 86, and a small circular wall 88 between them. The forward set of threads 84 are configured to mate with the external threads 30 on the front housing portion 22, an the rearward set of threads 86 are configured to mate with the external threads 60 on the rear housing portion 21. The orientation of the threads are such that, when the clamp 31 is turned in a first direction, the external threads 30 on the front housing 22 and the external threads 60 on the rear housing 21 will pull the two housing portions 21, 22 towards each other, and when the clamp 31 is turned in the opposite direction, the two housing portions 21, 22 will be pushed apart. The thread sets can be opposing or in the same direction, so long as the rotation in a first direction will pull the housing portions 21, 22 together. A set of grips 90 are spaced around the outer surface of the clamp 31. The grips 90 allow for adequate engagement with the clamp 31 when turning with the appropriate torque, to assure that the desired clamp load is applied between the assembled portions of the housing assembly 20.

After assembly to the desired torque, a locking hole is then drilled through the clamp 31 and a short distance into the rear housing portion 21. A locking pin 92 is inserted into the locking hole to assure that the clamp 31 cannot work its way loose over time. In the alternative, a keyway or other locking mechanism may be employed to retain the clamp 31 in the desired position.

Figure 6:
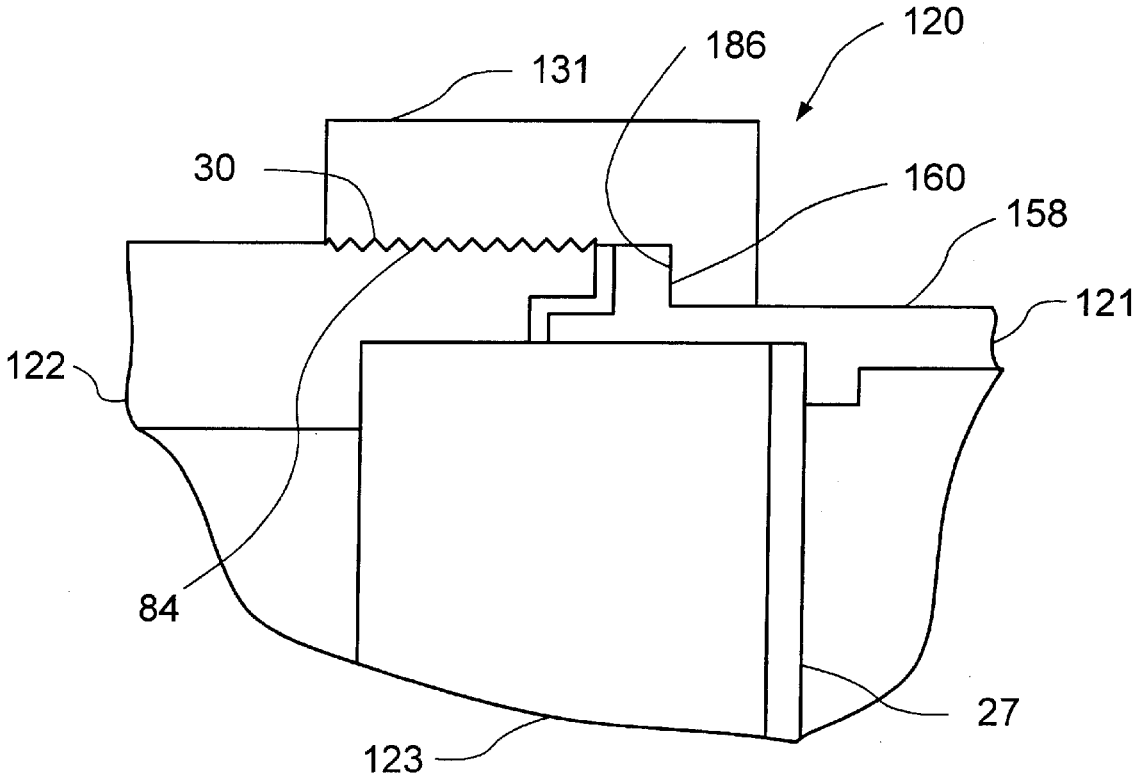
FIG. 6 is a schematic sectional view, similar to FIG. 3 but illustrating a second embodiment of the present invention.

FIG. 6 illustrates a second embodiment of the present invention. In this embodiment, elements that are the same as in the first embodiment will be designated with the same element numbers, but those that have changed or been added will be designated with 100 series numbers. The valve plate assembly 27 and the cylinder block 123 mount within the forward housing portion 122 and the rearward housing portion 121. The clamp 131 is slid over the outer surface 158 of the rear housing 121 until a shoulder 186 on the clamp 131 abuts a shoulder 160 on the rear housing 121. The threads 30 on the forward housing 122 are engaged with the forward threads 84 on the clamp 131. The clamp 131 is then turned, pulling the front 122 and rear 121 housings together until the desired clamping force is achieved.

Of course, O-ring seals (not illustrated in FIG. 6) can be located similar to those in the first embodiment to assure the proper sealing of the housing assembly 120. Also, the configuration can be reversed so that the shoulder is on the front housing and the threads on the rear housing, if so desired.

While certain embodiments of the present invention have been described in detail, those familiar with the art to which this invention relates will recognize various alternative designs and embodiments for practicing the invention as defined by the following claims.

What is claimed is:

1. A compressor for an air conditioning system comprising:

a first housing including an outer wall having an end with external threads thereon and an inner wall defining an inner cavity;

a component mounted partially within the inner cavity and including an outer surface sealingly engaging the inner wall;

a second housing including an inner wall defining an inner cavity for sealingly receiving a portion of the component along the component outer surface, and with the second housing including an engagement portion having an engagement device thereon; and a clamping member that is generally a hollow cylindrical shape and includes a first set of internal threads that threadably engage the external threads on the first housing, and a second engagement device operatively engaging the engagement portion of the second housing such that rotation of the clamping member in a first direction will cause the first and the second housings to be pulled toward one another, and rotation of the clamping member in a second opposite direction will allow the first and the second housings to be released from one another.

2. The compressor of claim 1 wherein the component is a cylinder block.

3. The compressor of claim 2 further including a valve plate mounted between the cylinder block and the second housing.

4. The compressor of claim 3 further including a clamp lock operatively engaging the clamping member and one of the first housing and the second housing, thereby preventing rotation therebetween.

5. The compressor of claim 2 wherein the cylinder block is made of iron and is sealed within the first and the second housings.

6. The compressor of claim 5 wherein the first housing and the second housing are made of aluminum.

7. The compressor of claim 2 further including a first seal mounted between the cylinder block and the first housing and a second seal mounted between the cylinder block and the second housing.

8. The compressor of claim 7 further including a third seal mounted between the first housing and the second housing.

9. The compressor of claim 1 wherein the engagement portion of the second housing is a set of threads, and the engagement device on the clamping member is a set of corresponding threads engaged with the set of threads on the second housing.

10. The compressor of claim 1 wherein the engagement portion of the second housing is a radially outward extending shoulder, and the engagement device on the clamping member is a radially inward extending shoulder engaged with the shoulder on the second housing.

11. The compressor of claim 1 wherein the clamping member has an outer surface, and the outer surface includes grips spaced thereabout.

12. The compressor of claim 1 wherein the first and the second housings are made of aluminum and the clamping member is made of steel.

13. A compressor for an air conditioning system comprising:

a first housing including an outer wall having an end with external threads thereon and an inner wall defining an inner cavity;

a component mounted partially within the inner cavity and including an outer surface sealingly engaging the inner wall;

a second housing including an inner wall defining an inner cavity for sealingly receiving a portion of the component along the component outer surface, and with the second housing including a second set of external threads; and a clamping member that is generally a hollow cylindrical shape and includes a first set of internal threads that operatively engage the external threads on the first housing, and a second set of internal threads operatively engaging the second set of external threads such that rotation of the clamping member in a first direction will cause the first and the second housings to be pulled toward one another, and rotation of the clamping member in a second opposite direction will allow the first and the second housings to be pushed away from one another.

14. The compressor of claim 13 further including a first seal mounted between the component and the first housing and a second seal mounted between the component and the second housing.

15. The compressor of claim 13 wherein the component is a cylinder block.

16. The compressor of claim 13 further including a valve plate mounted between the component and the second housing.

17. The compressor of claim 13 wherein the clamping member has an outer surface, and the outer surface includes grips spaced thereabout.

18. A compressor for an air conditioning system comprising:

a first housing including an outer wall having an end with external threads thereon and an inner wall defining an inner cavity;

a component mounted partially within the inner cavity and including an outer surface sealingly engaging the inner wall;

a second housing including an inner wall defining an inner cavity for sealingly receiving a portion of the component along the component outer surface, and with the second housing including a radially outward extending shoulder; and a clamping member that is generally a hollow cylindrical shape and includes a first set of internal threads that threadably engage the external threads on the first housing, and a radially inward extending shoulder engaged with the shoulder on the second housing such that rotation of the clamping member in a first direction will cause the first and the second housings to be pulled toward one another, and rotation of the clamping member in a second opposite direction will allow the first and the second housings to be released from one another.

19. The compressor of claim 18 wherein the component is a cylinder block, and the compressor further includes a valve plate mounted between the cylinder block and the second housing.

20. The compressor of claim 18 further including a clamp lock operatively engaging the clamping member and one of the first housing and the second housing, thereby preventing rotation therebetween.

* * * * *